US007515858B2

(12) United States Patent
Tamemasa

(10) Patent No.: US 7,515,858 B2
(45) Date of Patent: Apr. 7, 2009

(54) FLUOROCARBON RESIN-COATED MEMBER WITH A SPECIFIED RELATIVE FILM DENSITY, MANUFACTURING METHOD THEREOF, FIXING DEVICE USING THE MEMBER, AND IMAGE FORMING APPARATUS USING THE DEVICE

(75) Inventor: Hiroshi Tamemasa, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 206 days.

(21) Appl. No.: 11/293,174

(22) Filed: Dec. 5, 2005

(65) Prior Publication Data

US 2007/0048046 A1 Mar. 1, 2007

(30) Foreign Application Priority Data

Aug. 25, 2005 (JP) ..... 2005-245010

(51) Int. Cl.
*G03G 15/20* (2006.01)

(52) U.S. Cl. ..... 399/333

(58) Field of Classification Search ..... 399/333, 399/328

See application file for complete search history.

(56) References Cited

U.S. PATENT DOCUMENTS 3,341,348 A * 9/1967 Letendre ..... 428/173
5,153,660 A * 10/1992 Goto ..... 399/331
5,547,759 A * 8/1996 Chen et al. ..... 428/421
5,991,591 A * 11/1999 Chen et al. ..... 399/325
6,355,352 B1 * 3/2002 Chen et al. ..... 428/421
6,555,229 B1 * 4/2003 Chen et al. ..... 428/421
6,927,006 B2 * 8/2005 Finn et al. ..... 430/124.35
2002/0031383 A1 * 3/2002 Saito et al. ..... 399/333
2005/0220511 A1 * 10/2005 Wu et al. ..... 399/333

FOREIGN PATENT DOCUMENTS

JP B2 3-80277 12/1991
JP B2 7-43556 5/1995
JP A 11-5059 1/1999
JP A 2001-277266 10/2001
JP A 2004-109529 4/2004

* cited by examiner

*Primary Examiner*—Quana M Grainger
(74) *Attorney, Agent, or Firm*—Oliff & Berridge, PLC

(57) ABSTRACT

The invention provides a fluorocarbon resin-coated member which has at least a base material and a releasing layer formed thereon, wherein the releasing layer is a film obtained by sintering fluorocarbon resin particles, and the relative film density of the releasing layer is 98% or more. The invention further provides a method for manufacturing the fluorocarbon resin-mated member which at least includes coating a material containing fluorocarbon resin particles on the base material and sintering the fluorocarbon resin particles by using a hot isostatic pressing apparatus. The invention further provides a fixing device and an image forming apparatus having the fixing device, in which the fixing device has at least a pair of fixing units including a heating member and a pressurizing member. At least one of the heating member and the pressurizing member has the base material and the releasing layer.

16 Claims, 4 Drawing Sheets

FLUOROCARBON RESIN-COATED MEMBER WITH A SPECIFIED RELATIVE FILM DENSITY, MANUFACTURING METHOD THEREOF, FIXING DEVICE USING THE MEMBER, AND IMAGE FORMING APPARATUS USING THE DEVICE

CROSS-REFERENCE TO RELATED APPLICATION

This application claims priority under 35 USC 119 from Japanese Patent Application No. 2005-245010, the disclosure of which is incorporated by reference herein.

BACKGROUND OF THE INVENTION

1. Field of Invention

The present invention relates to a fluorocarbon resin-coated member suitable for a heating belt, a heating roll (including a pressurizing belt and a pressurizing roll) and the like for use in a fixing device; a manufacturing method thereof, a fixing device of sing a powder toner image formed on a support by applying heat and pressure simultaneously so as to fix the image; and an image forming apparatus which uses the fixing device.

2. Description of the Related Art

Conventional apparatuses which use an electrophotographic process, such as copying machines, require fusing unfixed toner images formed on recording sheet so as to form the unfixed toner images into a permanent image. Methods that are known as the fixing method include a solvent fixing method, a pressure fixing method, and a thermal-fixing method. The solvent-fixing method has a defect of frequent occurrence of odor and hygienic problems caused by evaporation of solvents. On the other hand, the pressure-fixing method also has a defect that the fixing efficiency thereof is lower than that of other fixing methods. Thus, both methods have not been widely commercialized. Instead, the thermal-fixing method of fusing the toner on the recording sheet (recording medium) generally by heating is used widely in fixing an unfixed toner image.

A typical example of conventionally-known thermal-fixing devices for use in the thermal-fixing method is a device which uses a thermal-fixing roll system The device has a heating roll which has a cylindrical metal core having a beater lamp inside thereof and a heat-resistant releasing layer on an external surface thereof, and a pressurizing roll having a heat-resistant elastomer layer formed on the peripheral surface of another cylindrical metal core placed in contact with the heating roll (fixing roll). An unfixed toner image formed on a supporting material such as plain paper is conveyed into and fixed between these rolls under a pressure of approximately 1 to 15 kg/cm$^2$, preferably approximately 3 to 10 kg/cm$^2$. The heating roll-fixing device used in this system is more widely used because it is superior in energy conservation and speed because of its thermal efficiency and free from fire hazards due to paper clogging in comparison to other thermal-fixing devices such as hot air-fixing or oven-fixing processes.

In order to satisfy the recent need for further acceleration of fixing in such a heating roll-fixing device, it is necessary to expand the width of the nip region, i.e., nip width, to match with the increase in fixing speed. Methods for expanding the nip width include increasing the load between rolls, increasing the thickness of an elastic layer of a fixing roll, expanding diameters of a fixing roll and a pressurizing roll, and the like. However, there are limitations to the fixing speed which can be made achieved by these methods, and thus a heating roll-and-belt firing device and a heating belt-and-roll fixing device have been developed for use in yet faster fixing ranges.

The fixing components (rolls and belts) for use in the heating roll-and-belt fixing device or heating belt-and-roll fixing device are roughly divided into two groups: 1) silicone rubber- or fluorine rubber-coated components in which a silicone or fluorine rubber is thinly coated on a base material via a primer: and 2) fluorocarbon resin-coated components in which a fluorocarbon resin such as a copolymer of tetrafluoroethylene and a perfluoroalkylvinylether (herein referred to as "PFA") or polytetrafluoroethylene (hereinafter referred to as "PTFE") is coated on a base material via a primer.

Among these fixing components, the silicone rubber-coated component contains silicone oils called free oils inside the materials thereof and these oils exert a significant influence in terms of releasing characteristics, and a fixing component containing the free oils in a greater amount shows better releasing characteristics. However, presence of the free oils causes problems of deterioration in rubber strength and deformation of the belt due to emission of the free oils.

On the other hand, fluorine rubber-coated components, which are very solid, higher in abrasion wearing resistance, and elastic, are effective in providing an image higher in quality. However, the fluorine rubber, which inherently repels the polydimethylsiloxane oil (silicone oil) commonly used as a release oil, is less effective in forming a releasing layer of the oil at the interface with the toner image. Thus, the combination of a fluorine rubber and a dimethylsiloxane oil (silicone oil) cannot be used when a low-melting point, high-coloring toner such as color toner is used, because it is inferior in releasing characteristics. A method of using a modified polydimethylsiloxane oil in which part of the polydimethylsiloxane oil is modified with a mercapto group —SH or an ammo group —$NH_2$ has been proposed to overcome the problem. In such a case, the functional group such as mercapto or amino reacts with the metal oxides (e.g., MgO, PbO, or the like) and the double bonds contained in the fluorine rubber, allowing formation of a thin silicone oil film at the molecular level on the belt surface, which functions as a releasing layer and modifies the fixing-component surface into a surface superior in releasing characteristics.

However, the silicone oil, which is effective in modifying the surface into a high-release surface, also makes the surface of a copying sheet or, during double-faced copying, a paper-supplying roll highly releasable at the same time, and thus, causes the problems, for example, that it is difficult to adhere a stationery tape or the like on a copying sheet obtained or to supply paper smoothly with the paper-supplying roll. If the amount of the modified silicone oil used is reduced or almost no modified silicone oil is used for prevention of such problems, the belt surface exhibits the rubbery stickiness inherent to the fluorine rubber and may cause the problem that the surfaces of the copier paper and the fluorine rubber-coated belt adhere to each other during fusion, prohibiting release of the copier paper from the fluorine rubber surface after fixing he problem becomes amplified when the copier paper is a coated paper higher in surface smoothness and, in particular, when the surface thereof is treated with a coating agent.

For prevention of generation of the problems above, there exists a need for a fixing component having a surface that is less sticky with respect to the copier paper and allowing more efficient release thereof, even during fixing when the amount of the modified silicone oil used is reduced or almost no modified silicone oil is used. There is a requirement for the firing component that the adhesiveness between toner and fixing component is lower and the adhesiveness between copier paper and fixing component surface is lower even when the input of modified silicone oil during fusion is low.

For satisfying these requirements, a fluorocarbon resin material has come to be used more frequently as the surface layer material formed on the fixing component surface. Examples of the fluorocarbon resin materials formed on the fixing component surface include fluorocarbon resin tube materials prepared by beat-melting and extruding a fluorocarbon resin and fluorocarbon resin-coated materials prepared by coating, drying, and sintering a coating material containing a fluorocarbon resin powder dispersed in a solution on a base material.

The fluorocarbon resin tube material and the fluorocarbon resin-coated aerial have respective advantages and disadvantages. The fluorocarbon resin tube material has an advantage that the material properties thereof are similar to bulk fluorocarbon resin (i.e., the abrasion wearing resistance and the like are superior), but also has a disadvantage that it is difficult to process it into various shapes because of constraints in processing methods.

On the other hand, the fluorocarbon resin-coated material has an advantage that it is possible to process it into various shapes easily by coating technology, but also has a disadvantage that the material properties thereof, in particular abrasion wearing resistance, are inferior to those of bulk fluorocarbon resin because it is a sintered powder.

On the other hand, as described above, there currently exists a need recently for further increase in the fixing speed of fixing devices, and to satisfy this need, it is necessary to expand the width of nip region, i.e., nip width, to match the increase in fixing speed. Methods of increasing the load applied between rolls, thickening the elastic layer of fixing roll, and increasing the diameters of the fixing and pressurizing rolls, and also heating roll-and-belt-fixing or heat belt/roll-fixing devices are under development aimed at expanding the nip width. When a fixing device is further accelerated, the stress applied to the fixing components also increases. In particular, the abrasion stress applied to the fluorocarbon resin material, the surface layer material of the fixing component, increases significantly. It is obvious that use of a fluorocarbon resin-coated material as the surface layer material of the fixing component under such high stress conditions results in the problem of frequent trouble due to abrasion of the surface layer material.

A method of smoothing the fluorocarbon resin-coated surface at normal temperature with a pressurizing roll and then heat-treating the fluorocarbon resin-coated surface (see, for example, Japanese Patent Application Publication (JP-B) No. 3-80277) and a method of softening the fluorocarbon resin-coated surface at 250 to 300° C. and smoothing it with a pressurizing roll (see, for example, Japanese Patent Application Laid-Open (JP-A) No. 2004-109529) we, for example, known as methods to overcome this problem; but because the treatment temperature is lower than the melting point of the fluorocarbon resin, these methods still have the problems that it is impossible to raise the density of the fluorocarbon resin-coated layer sufficiently and to apply a pressure uniformly to the fixing component surface during pressurization with a pressurizing roll.

Also known are a method of bringing the fluorocarbon resin-coated surface into contact with a heater previously heated to a temperature of not lower than the melting point under pressure and heating the surface while rotating the heater surface or the coated surface (see, for example, JP-B No. 7-43556) and a method of coating a fluorocarbon resin powder on a cylindrical base material, inserting the base material in another cylinder having an inner diameter slightly larger than the external diameter of the base material, and applying heat and pressure by using the difference in thermal expansion coefficients thereof (see, for example, JP-A No. 11-5059 or 2001-277266); but these methods also had the problem that it was not possible to raise the density of the fluorocarbon resin-coated layer uniformly, because it was not possible to apply pressure uniformly to the fixing component surface during pressurization by using the pressurizing roll and the pressurizing member (cylinder).

SUMMARY OF THE INVENTION

The invention takes into account the above problems and provides a fluorocarbon resin-coated member that has the advantages of fluorocarbon resin-coated material being convenient in processing into various shapes and having a high abrasion wearing resistance equivalent to that of bulk fluorocarbon resin. Further, the invention provides a manufacturing method thereof, and a fixing device using the same.

Namely, the invention provides a fluorocarbon resin-coated member, comprising a base material and a releasing layer formed thereon, wherein: the releasing layer is a film obtained by sintering fluorocarbon resin particles; and the relative film density of the releasing layer is 98% or more.

The invention further provides a method for manufacturing a fluorocarbon resin-coated member, comprising: coating a fluorocarbon resin coating material which comprises fluorocarbon resin particles on a base material; and sintering the fluorocarbon resin particles by pressurizing the fluorocarbon resin particles at a temperature which is equal to or higher than the melting point of the fluorocarbon resin particles by using a hot isostatic pressing apparatus, wherein a releasing layer having a relative film density of 98% or more is formed thereby.

The invention further provides a fixing device, comprising a pair of fixing units, including of a heating member and a pressurizing member which is brought into contact with the heating member with pressure, which conveys a recording medium carrying an unfixed toner image through a nip region formed by the heating member and the pressurizing member so that the unfixed image is fixed to the recording medium by heat and pressure, wherein at least one of the heating member and the pressurizing member comprises a base material and a releasing layer formed thereon; the releasing layer is a film obtained by sintering fluorocarbon resin particles; and the relative film density of the releasing layer is 98% or more.

The invention further provides an image forming apparatus comprising: a toner image forming unit which provides an unfixed toner image on a recording medium; and a fixing device which fixes the unfixed toner image to the recording medium, wherein the fixing device comprises a pair of fixing units including of a heating member and a pressuring member which is brought into contact with the heating member with pressure, and conveys the recording medium carrying the unfixed toner image trough a nip region formed by the healing member and the pressurizing member so that the unfixed image is fixed to the recording medium by heat and pressure; at least one of the heating member and the pressurizing member comprises a base material and a releasing layer formed thereon; the releasing layer is a film obtained by sintering fluorocarbon resin particles; and the relative film density of the releasing layer is 98% or more.

DETAILED DESCRIPTION OF INVENTION

Figure 1:
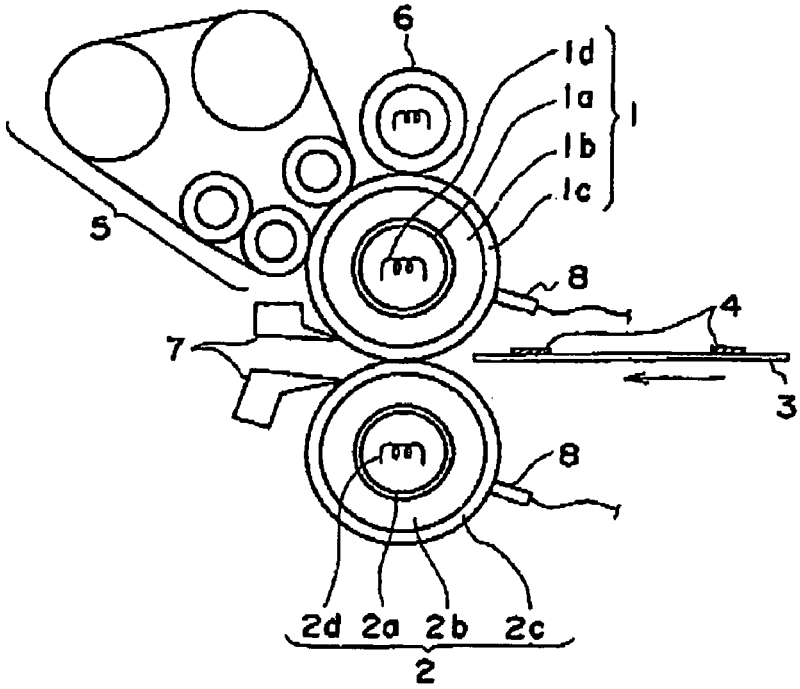
FIG. 1 is a schematic view showing a configuration of a heating roll-fixing device relating to a first embodiment of the fixing device of the present invention.

Hereinafter, details of the fluorocarbon resin-coated material of the invention, a manufacturing method thereof, and a fixing apparatus of the invention is described. Fluorocarbon resin-coated material and Manufacturing method thereof.

The fluorocarbon resin coated member of the present invention is characterized by having at least a base material and a releasing layer formed thereon, wherein the releasing layer is a film obtained by sintering fluorocarbon resin particles, and the relative film density of the releasing layer is 98% or more.

By adjusting the relative film density of the releasing layer to approximately 98% or more, it becomes possible to make the abrasion wearing resistance of the releasing layer obtained by sintering fluorocarbon resin particles equivalent to the abrasion wearing resistance of the releasing layer obtained by processing bulk fluorocarbon resin. A releasing layer having a relative film density of less than 98%, in which the bonding force among fluorocarbon resin particles is weaker, occasionally has a lowered strength or a lowered abrasion wearing resistance.

The relative film density of the releasing layer is preferably approximately 98.5% or more, and more preferably approximately 99% or more.

The relative film density according to the invention is determined by forming a film (50×50 mm), separating it from a base material used for forming the film, measuring a weight of the film, measuring a volume thereof by immersing the film in water, and calculating a specific density (D) of the film in accordance with the following equation.

$$\text{Film specific density } (D) = \text{Weight of film } (W) / \text{Volume of film } (V)$$

Then, the relative film density (%) is calculated according to the following equation.

$$\text{Relative film density } (\%) = \text{Film specific density } (D) / \text{Absolute specific gravity of releasing laver material.}$$

The fluorocarbon resin-coated member according to the invention is favorably used as the heating member and/or the pressurizing member in fixing device.

A shape, raw materials and the like for the base material according to the invention are not particularly limited When the fluorocarbon resin coated member according to the invention is used as the heating member and/or the pressurizing member in a fixing device, examples of the base material used therefore include a cylindrical metal core and an endless belt.

Specific examples of the cylindrical metal core include a metal pipe. Materials of the cylindrical metal core include Fe, Al, Cu and the like. An external diameter and a thickness of the cylindrical metal core are properly selected according to its application.

For example, the external diameter may be decided according to a nip width desirable when the fluorocarbon resin-coated member is used in a fixing device. Alternatively, when it is used as a heating member, in view of shortening a warm-up time of the heating member, the thickness of the cylindrical metal is preferably a lowest value that withstands a nip pressure favorably used in a fixing device.

The endless belt is not particularly limited with the proviso that it has a strength withstanding a tension applied by supporting rolls and pressing rolls, and examples thereof include polymer films, metal films, ceramic films, glass fiber films, and composite films formed by compositing two or more of them.

Examples of the polymer films include sheet- or cloth-shaped moldings of polyesters (e.g., polyethylene terephthalate), polycarbonates, polyimides, fluorocarbon polymers (e.g., polyvinyl fluoride and polytetrafluoroethylene), polyamides (e.g., nylon), polystyrene, polyacrylics, polyolefins (e.g., polyethylene and polypropylene), modified celluloses (e.g., polycellulose acetate), polysulfones, polyalkylenes, polyacetals, and the like; as well as polymer composites prepared by laminating a heat-resistant resin layer (e.g., of a fluorocarbon polymer, a silicone-based polymer, or a crosslinked polymer) on a general-purpose polymer sheet.

Among them, the endless belt is preferably made of a heat-resistant resin.

In addition, the polymer film may be laminated with a heat-resistant layer formed of metal, ceramic, or the like, and may contain a thermal-conductivity improving agent such as carbon black graphite, alumina, silicone, carbide, or boron nitride in a shape of powder, needle, fiber, or the like. Further, in accordance with necessity, additives such as a conductive agent, an antistatic agent, a releasing agent, or a reinforcing agent may be added inside or on the surface of the polymer film.

In addition to the polymer films, example of the material of the endless belt further include papers such as capacitor paper or glassine paper, ceramic films, glass fiber films formed by molding glass fibers in a cloth-shape, and metal films such as stainless steel film or nickel film.

A primer layer may be coated on the base material of the fluorocarbon resin-coated member according to the invention as an adhesive for improving an adhesiveness between the releasing layer and the base material.

Examples of the materials for the primer layer include PRIMER 902YL (trade name, manufactured by DuPont-Mitsui Fluorochemical Co., Ltd.), PRM067 (trade name, manufactured by DuPont-Mitsui Fluorochemical Co., Ltd.), and the like.

A thickness of the primer layer is preferably in a range of approximately 0.05 to 2.0 μm and more preferably in a range of approximately 0.1 to 0.5 μm.

An elastomer layer may be formed between the releasing layer and the base material of the fluorocarbon resin-coated member according to the invention so that the nip region formed by the heating member described below and the pressurizing member can be adjusted to a particular width. The elastomer layer may be formed with a heat-resistant rubber such as silicone rubber or a fluorocarbon rubber.

Examples of the fluorocarbon resin particles used in the fluorocarbon resin-coated member according to the invention include fluorocarbon resin powders of a copolymer of tetrafluoroethylene and a perfluoroalkylvinylether (hereinafter, referred to as "PFA"), polytetrafluoroethylene (hereinafter, referred to as "PTFE"), and the like.

An average diameter of the fluorocarbon resin particles is preferably in a range of approximately 0.1 to 30 μm, more preferably in a range of approximately 0.1 to 15 μm, and still more preferably in a range of approximately 0.1 to 10 μm.

The "average diameter" referred in the invention means a volume-average particle size, unless specified otherwise.

In addition, the releasing layer is preferably formed with two kinds of fluorocarbon resin particles which are different in particle diameter in view of obtaining a surface superior in durability (preservation of film thickness).

Uses of smaller-diameter fluorocarbon resin particles, which are lower in melt viscosity and/or which melt easily, is preferable for forming a non-wavy smooth releasing layer (surface layer), however, uses of small-diameter fluorocarbon resin particles alone often cause a problem of film cracking when a coated film (surface layer) having a thickness of approximately 20 μm or more is formed in a single casting process. An excessively thinner surface layer (fluorocarbon resin film) may results in deterioration in durability due to abrasion when used for an extended period of time.

By properly adjusting the particle diameters and a blending ratio of two kinds of fluorocarbon resin particles different in particle diameter (larger-diameter fluorocarbon resin fine particles and smaller-diameter fluorocarbon resin fine particles), it becomes possible to form a surface layer (fluorocarbon resin film) with a thickness of up to approximately 60 μm in a single casting process and thus reduce a production cost.

When the average diameter of the blended larger-diameter fluorocarbon resin particles is smaller than approximately 3 μm and the amount of the larger-diameter fluorocarbon resin particles blended is less than approximately 5 parts by weight with respect to 100 parts by weight of the smaller-diameter fluorocarbon resin fine particles, the surface layer (fluorocarbon resin film) often has cracks.

On the other hand, when the average diameter of the larger-diameter fluorocarbon resin particles is greater than approximately 15 μm and the amount thereof is more than approximately 30 parts by weight with respect to 100 parts by weight of the smaller-diameter fluorocarbon resin fine particles, the larger-diameter fluorocarbon resin particles do not completely melt during sintering and may remain as powder on the surface of the surface layer (fluorocarbon resin film), causing waviness (obtuse protrusion) due to the larger-diameter fluorocarbon resin.

As for the two kinds of fluorocarbon resin particles different in particle diameter, a melt viscosity of the smaller-diameter fluorocarbon resin fine particles at a temperature of approximately 380° C. is preferably in a range of approximately $35\times10^4$ poises ($3.5\times10^4$ Pa·s) or less, and that of the larger-diameter fluorocarbon resin particles is preferably in a range of approximately $15\times10^4$ poises ($1.5\times10^4$ Pa·s) or less. In the ranges above, it is possible to improve the waviness of surface layer.

In view of further improving the waviness of the surface layer, both of the melt viscosities of the two kinds of fluorocarbon resin particles different in particle diameter preferably are in a range of approximately $15\times10^4$ poises ($1.5\times10^4$ Pa·s) or less, more preferably in a range of approximately $10\times10^4$ poise ($1.0\times10^4$ Pa·s) or less, and particularly preferably $5\times10^4$ poise ($0.5\times10^4$ Pa·s) or less at 380° C. When the melt viscosity of the fluorocarbon resin particles at 380° C. is greater than approximately $15\times10^4$ poise, the melted fluorocarbon resin does not spread on the surface of the surface layer, causing waviness of the surface.

The releasing layer according to the invention may additionally contain a filler. Preferable examples of the filler to be blended in the releasing layer include a material selected from the group consisting of metal oxide fine particles, silicate salt minerals, carbon black, nitrogen compounds, and mica.

More preferable examples thereof include those selected from the group consisting of $BaSO_4$, zeolite, silicon oxide, tin oxide, copper oxide, iron oxide, zirconium oxide, ITO (tin-doped indium oxide), silicon nitride, boron nitride, titanium nitride and mica; still more preferable examples thereof include those selected from the group consisting of $BaSO_4$, zeolite and mica; further preferable examples thereof include $BaSO_4$ and zeolite; and particularly preferable example thereof is $BaSO_4$.

The blending content of the filler is arbitrary, and preferably in a range of approximately 1 part or more and 30 part or less by weight with respect to 100 parts by weight of the fluorocarbon resin particles, and more preferably in a range of approximately 1 part or more and 20 part or less by weight, with respect to 100 parts by weight of the fluorocarbon resin particles. When the blending content of the filler is smaller than approximately 1 part by weight, a resulting releasing layer is superior in releasing property of toner and paper because of the superior releasing characteristics of the fluorocarbon resin. However, at the same time troubles in the fixing device tend to easily occur because of surface abrasion and scratches tend to easily occur due to deterioration in abrasion wearing resistance against materials which are brought into contact therewith such as releasing blade. Alternatively, when the content is greater than approximately 30 parts by weight, it is more difficult to obtain a uniform dispersion state, resulting in unevenness of film thickness. Further, a high-releasing characteristics inherent to fluorocarbon resin decline rapidly, causing more frequent toner offsetting increase in the roughness of surface layer, and deterioration in surface smoothness such as glossiness. Further, when such a condition is applied to a pressurizing belt (fixing belt), the roughness of surface layer and the deterioration in surface smoothness may give an image inferiority in glossiness and smoothness.

The average diameter of the filler is preferably in a range of approximately 0.1 μm or more and 15 μm or less, more preferably in a range of approximately 1 μm or more and 10 μm or less, and still more preferably in a range of approximately 2 μm or more and 8 μm or less. Preferably, the average diameter is in a range of approximately 1 μm or more and 10 μm or less, and the content of particles having a diameter of approximately 15 μm or more is preferably in a range of approximately 25 wt % or less. In particular, in view of preventing sharp protrusions on the surface layer, the average diameter of the filler is preferably in a range of approximately 1 μm or more and 10 μm or less, and the content of particles having a diameter of approximately 15 μm or more is in a range of approximately 5 wt % or less, more preferably the content of particles having a diameter of approximately 15 μm or more is in a range of approximately 3 wt % or less.

When the average diameter of filler becomes smaller than approximately 0.1 μm, the powder has a larger surface area, which makes it difficult to add and disperse the filler in PFA. Alternatively, when the average diameter of filler becomes greater than 10 μm, it may lead to a problem of roughening the PFA filler-added surface layer. Alternatively, when the content of the particles having a diameter of approximately 15 μm or more is above the range of 5 wt % in the filler, filler particles having a large diameter tend to become sharp protrusions, which may stick to a formed image (during double-faced printing), which generate white-patched image defects.

Alternatively, conductive particles may also be used as the finer. There are cases where the fixing device should be imparted conductivity, depending on the various conditions of electrophotographic system, and in such a case, conductive particles may be blended as the filler to the fluorocarbon resin. Particles other than the particular fillers described above may be used as the conductive particles. When conductive particles are used as tee filler, the conductive particles are preferably added in an amount of approximately 1 part or more and 10 parts or less by weight with respect to 100 parts by weight of the fluorocarbon resin particles, accounting for objects of imparting conductivity to the fixing device, preservation of a preferable releasing characteristics of the fluorocarbon resin, and dispersing the conductive particles.

The fluorocarbon resin-coated member according to the invention is preferably manufactured by a method which includes at least coating a fluorocarbon resin coating material which contains at least fluorocarbon rein particles on a base material and sintering the fluorocarbon resin particles by pin g the fluorocarbon resin particles at a temperature which is equal to or higher than the melting point of the fluorocarbon resin particles by using a hot isostatic pressing apparatus.

Examples of a method for applying the fluorocarbon resin coating material on the base material according to the invention include generally practiced methods such as wet methods including Cay coating and dip coating or dry methods including electrostatic coating.

A liquid fluorocarbon resin coating material is usually used in the wet methods (such as the spray coating or the dip coating). A liquid dispersion medium for use in the liquid fluorocarbon resin coating materials is normally water. However, it may contain an organic solvent as needed, or alternatively, a mixture of water and an organic solvent such as alcohol may be used instead so as to facilitate drying after application.

A surfactant is preferably used in order to disperse the fluorocarbon resin particles and the filler, which is added in accordance with necessity, in the liquid medium. The surfactant is preferably an anionic or nonionic surfactant. The surfactants may be used alone or in combination of two or more kinds thereof. Among them, nonionic surfactants are particularly preferable. An amount of the surfactant is not particularly limited, but normally, is an amount sufficient for dispersing the fluorocarbon resin particles and the filler, which is added in accordance with necessity, uniformly in the liquid medium.

A viscosity increasing agent may also be used in view of facilitating a coating operation and a control of a film thickness. An amount of the viscosity increasing agent added is not particularly limited. Be amount of de viscosity increasing agent may be varied according to the application method in view of facilitating coating operation.

A drying temperature of the surface layer coated by the wet method (the spray coating or the dip coating) is a temperature that allows evaporation of the liquid dispersion medium used, and preferably in a range of approximately 50° C. to 200° C., more preferably in a range of approximately 60° C. to 180° C., and still more preferably in a range of approximately 70° C. to 150° C.

The dry method (electrostatic coating) utilizes a solid (powder) fluorocarbon resin coating material. The fluorocarbon r particles described above may be used as the powder fluorocarbon resin coating material. The filer described above may be added to the fluorocarbon resin particles in accordance with necessity.

The fluorocarbon resin coating material may be applied to or coated on the base material electrostatically by applying a averse electric potential between the base material and the fluorocarbon resin coating material.

The hot isostatic pressing (HIP) machine used in the invention is used for pressurizing eminent with heat by using an inert gas (Ar, $N_2$, or the like) as a pressure medium. The treatment allows more uniform application of pressure under heat to base materials in various shapes relative to conventional hot-pressing methods.

A heating temperature used by the hot isostatic pressing apparatus used in the invention is preferably a temperature of not lower than a melting point of the fluorocarbon resin, more preferably higher than the melting point by approximately 10° C. or more, and still more preferably higher than the melting point by approximately 20° C. or more. When the heating temperature is lower than the melting point of the fluorocarbon resin, the fluorocarbon resin does not melt sufficiently, making it difficult to obtaining a desired relative film density of the layer.

When the fluorocarbon resin coating material contains a filler, an upper limit of the heating temperature is preferably equal to or lower than a temperature which is higher than the melting point of the fluorocarbon resin by approximately 100° C., more preferably equal to or lower than a temperature which is higher than the melting point of the fluorocarbon resin by approximately 70° C., and still more preferably equal to or lower than a temperature which is higher than the melting point of the fluorocarbon resin by approximately 50° C. A lower limit of the heating texture is preferably equal to or higher than the melting point of the fluorocarbon resin, more preferably equal to or higher than a temperature which is higher than the melting point of the fluorocarbon resin by approximately 10° C., and still more preferably equal to or higher than a temperature which is higher than the melting point of the fluorocarbon resin by approximately 20° C. or higher. When the heating temperature is higher than a temperature which is higher than the melting point of the fluorocarbon resin by approximately 100° C. the filler dispersed in the releasing layer may migrate so as to generate aggregates thereon and prevent providing of a film having did film properties (surface roughness, friction coefficient, abrasion wearing resistance, conductivity, etc.).

A pressure of the hot isostatic pressing apparatus used in the invention is preferably approximately 100 MPa or more, more preferably approximately 200 MPa or more, and still more preferably approximately 300 MPa or more. When the pressure is approximately less than 100 MPa, it may be impossible to apply sufficient pressure to the fluorocarbon resin to obtain a desired relative film density of the layer.

Fixing Device

The fixing device according to the invention is a fixing device having a pair of fixing units, a heating member and a pressurizing member which is brought into contact with the heating member, wherein a recording medium carrying an unfixed toner image is conveyed through a nip region formed by the heating member and the pressurizing member so that the unfixed toner image is fixed to the recording medium by heat and pressure, and at least one of the hearing member and the pressurizing member is the fluorocarbon resin-coated member according to the invention.

It is possible to reduce occurrences of troubles associated with a fixing device by using the fluorocarbon resin-coated member according to the invention as at least one of the heating member and the pressurizing member.

Hereinafter, the fixing device according to the invention will be described with reference to drawings, but the invention is not limited to the following embodiments.

FIG. 1 is a schematic view illustrating the configuration of a heating roll-fixing device according to the first embodiment of the fixing device of the invention The heating roll-fixing device shown in FIG. 1 has a beating roll 1 and a pressurizing roll 2, that are facing each other and pressed to each other to form a nip region, as a fixing unit.

The heating roll 1 is a fluorocarbon resin-coated member according to the invention that has a metal hollow core 1*a* containing a heater lamp 1*d* therein, an elastomer layer 1*b* and a fluorocarbon resin releasing layer 1*c* formed on the metal hollow core 1*a* in this order. Placed surrounding an equal surface of the heating roll 1 are a cleaning device 5 for cleaning the surface of the heating roll 1, an external heating device 6 for additionally heating the spice of the heating roll 1, a releasing blade 7 for removing a recording medium 3 after fixation, and a temperature sensor 8 for controlling a surface temperature of the heating roll 1.

The pressurizing roll 2 has a metal hollow core 2*a* containing a heater lamp 2*d* therein, and an elastomer layer 2*b* and a releasing layer 2*c* formed on the metal hollow core 2*a* in this order. Placed surrounding an external surface of the pressurizing roll 2 are he releasing blade 7 for removing the recording medium 3 after fixation and the temperature sensor 8 for control of a surface temperature of the pressing roll 2.

The unfixed toner 4 can be fixed when the recording medium 3, that carries an unfixed toner 4, is passed through the nip region formed by the heating roll 1 and the pressurizing roll 2.

In the fixing device of the first embodiment, the fluorocarbon resin-coated member according to the invention is used as the heating roll 1. Alternatively, the fluorocarbon resin-coated member according to the invention may be used as the pressurizing roll 2, or as both of the heating roll 1 and pressurizing roll 2.

Figure 2:
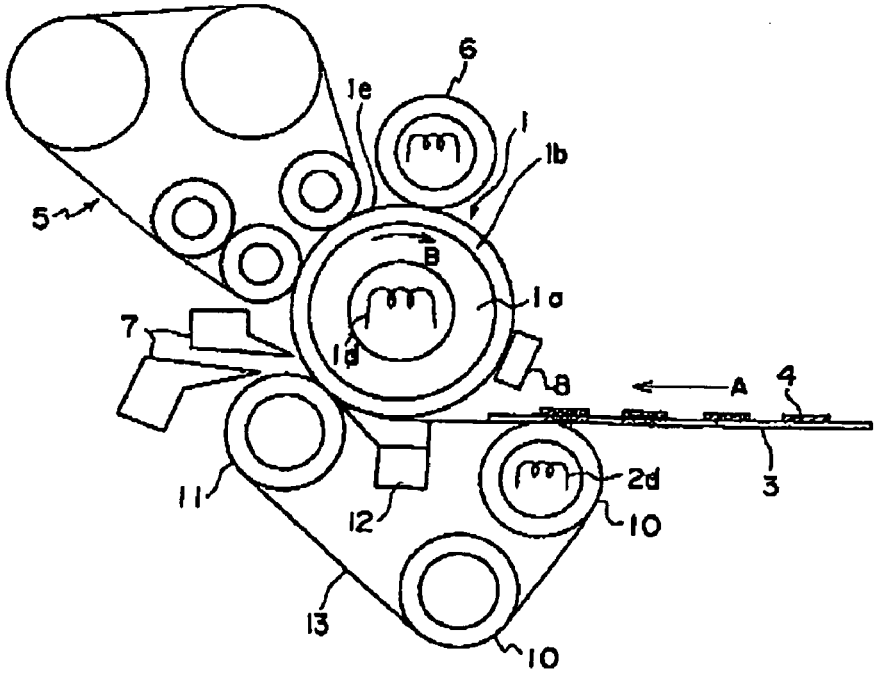
FIG. 2 is a schematic view showing a configuration of a heating roll-and-belt-fixing device relating to a second embodiment of the fixing device of the present invention.

FIG. 2 is a schematic view illustrating the configuration of another heating roll-and-belt-fixing device according to the second embodiment of the fixing device of the invention. The heating roll-and-belt-fixing device in the second embodiment is a device having a pair of fixing units, namely a beating roll and a pressurizing belt in contact with the heating roll, and a recording medium which carries an unfixed toner image and passes through the nip region formed by the heating roll and the pressurizing belt, so that the image is fixed by heat and pressure.

The heating roll-and-belt-fixing device shown in FIG. 2 has a heating roll 1 and a press belt 13 facing each other as a fixing unit The fluorocarbon resin-coated member according to the invention is used as the pressurizing belt 13. The pressurizing belt 13 is pressed to the heating roll 1 by a pressure pad 12 pressurizing member) and a pressurizing roll 11 (pressurizing member) placed inside the belt so as to forming the nip region. The pressure pad 12 (pressurizing member) has an area (pressurization area) in contact with the pressurizing belt 13 in a form of pad, and the contact area and a region close thereto may contain a rubbery elastic portion.

In the invention, the "The pressure pad 12 . . . has an area . . . in contact with the pressurizing belt 13 in a form of pad" means that the area of the pressure pad 12 in contact with the pressurizing belt 13 is in a form flat an entire area of the pressure pad is pressed to an internal face of the pressurizing belt 13, which is stretched by the heating roll 1, a pressurizing roll 11, and two supporting rolls 10. The "region close thereto" means a region that provides the contact area of the pressure pad 12 an elasticity with the elastic portion, and thus, the contact area and the region close thereto may not be specified definitely, but is preferably a region of the pressure pad 12 including the contact area and the region to a depth of approximately 10 mm therefrom. In addition, the phrase "the contact area and a region close thereto may contain a rubbery elastic portion" means that at least part of the contact area or the region close thereto is made of an elastic material. Typical examples of the rubbery elastic portion include a heat-resistant rubber such as silicone rubber or fluorine rubber.

The pressure pad 12 may have multiple pressurization areas which are different in hardness along the traveling direction of the recording medium. This configuration is preferable since it often has a soft pressurization area made of a rubber-like elastic material on one side and a hard pressurization made of material such as metal on the other side. Further, when the pressure pad 12 has multiple pressurization areas which are different in hardness, the pressure in the nip region is preferably higher in a region near to an outlet than in a region near to an inlet in view of improving releasing property of the recording medium (in particular, when the recording medium is thin). For example, it is possible to favorably make the pressure in the region near to the outlet higher than the pressure in the region near to the inlet in the nip region by making the region near the inlet in the pressurization portion in the pressure pad 12 with a rubber-like elastic material as well as making the region near the outlet in the pressurization portion with a hard pressure imparting material such as metal.

A sheet of a heat-resistant resin or a fluorocarbon resin may be placed on the pressure pad 12 as a low-friction sheet, for improving the lubrication between the pressure pad 12 and the internal surface of the pressuring belt 13.

The heating roll 1 has a metal hollow core 1*a* having a heater lamp 1*d* therein and an elastomer layer 1*b* and a releasing layer 1*e* formed on the metal hollow core 1*a* in this order. The metal core 1*a*, the elistomer layer 1*b*, and the releasing layer 1*e* may be prepared with any one of known materials.

The pressurizing belt 13 is stretched by two supporting rolls 10 and one pressurizing roll 11, and one of the supporting rolls 10 has a heater lamp 2*d* inside 4 represents an unfixed toner image formed on a recording medium 3 such as plain paper.

Placed surrounding tee heating roll 1 are a cleaning device 5 for cleaning a roll surface, an external heating device 6 for heating the heating roll 1 from the surface, a releasing blade 7 for removing paper after fixation, and a temperature sensor 8 for controlling a surface temperature of the heating roll 1.

In the fixing device shown in FIG. 2, a recording medium 3 carrying an unfixed toner image 4 on a surface thereof is conveyed in the direction indicated by arrow A by conveying means not shown in the figure and the pressurizing belt 13, and fed into a nip region formed by the heating roll 1 rotating in the direction indicated by arrow B and the pressurizing belt 13. At the time, the recording medium 3 is fed in a manner that a surface of the recording medium 3 carrying the unfixed toner image 4 and the surface of the heating roll 1 face each other. During passage of the recording medium 3 through the nip region, the unfixed toner image 4 is fixed onto the recording medium 3 by heat and pressure applied to the recording medium 3. After fixation, the recording medium is conveyed out of the nip region, removed from the heating roll 1 by the releasing blade 7, and ejected from the heating roll-and-belt-fixing device. A fixation process is attained in this way.

The fluorocarbon resin-coated member according to the second embodiment of the fixing device of the invention uses the fluorocarbon resin-coated member according to the invention as the pressurizing belt 13. Alternatively, the fluorocarbon resin-coated member may be used as the heating roll 1, or may be used both as the heating roll 1 and the pressurizing belt 13.

Figure 3:
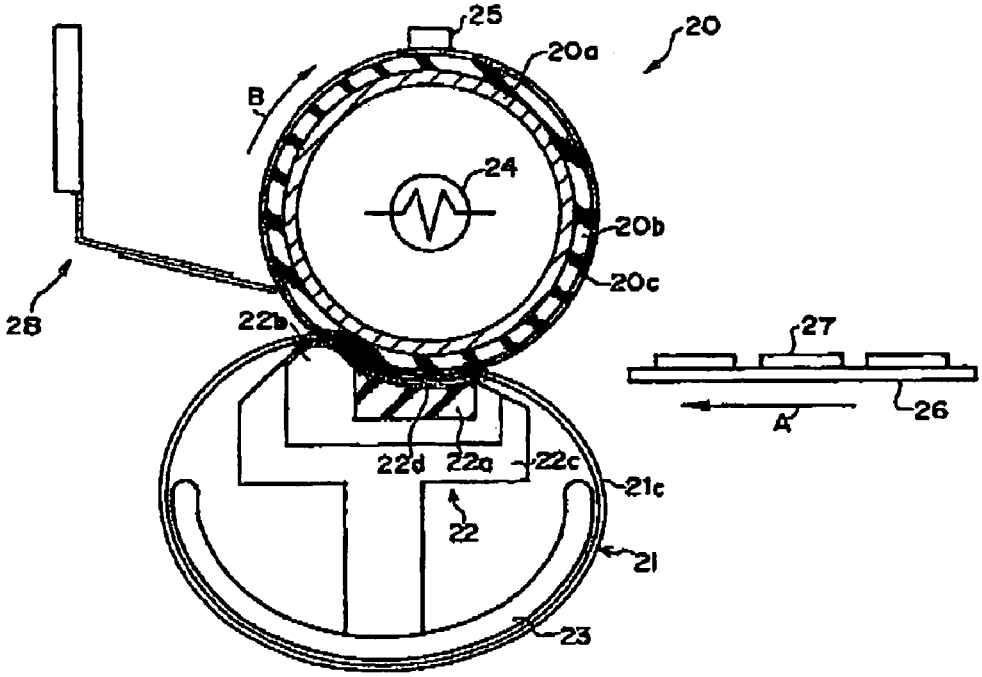
FIG. 3 is a schematic view showing a configuration of a free belt-fixing device relating to a modification of the second embodiment of the fixing device of the present invention.

FIG. 3 is a schematic view illustrating the configuration of a free belt-fixing device, a modification of the second embodiment of the fixing device of the invention. The fee belt-fixing device shown in FIG. 3 is a heating roll-and-belt-fixing device modified aiming at further decreasing a machine size, reduction in energy consumption and increase-in speed, and does not have a supporting roll or a pressurizing roll for stretching the belt. A pressurizing belt 21 is guided with a belt conveyance guide 23 and driven by a driving force from a heating roll 20. Such a belt-fixing device is called a free belt-fixing device so as to be differentiated from the kinds of devices having supporting rolls and pressurizing rolls (such as a fixing device shown in FIG. 2).

The free belt-fixing device shown in FIG. 3 has a pair of the heating roll 20 and the pressurizing belt 21 facing each other as a fixing unit. The fluorocarbon resin-coated member according to the invention having a specific releasing layer 21*c* is used as the pressurizing belt 21. The pressurizing belt 21 is pressed onto the heating roll 20 by a pressure pad 22 (pressing member) placed inside so as to form a nip region, and as described above, the belt is guided along the belt conveyance guide 23 and driven by the driving force from the heating roll 20.

The pressure pad 22 (pressurizing member) has multiple pressurization areas, 22*a* and 22*b*, which are different in hardness and positioned along the traveling direction of recording medium. By making the inlet-sided pressurization area 22*a* in the pressure pad 22 from a rubber-like elastic material and the outlet-sided pressurization area 22*b* from a hard pressurization material such as metal, the pressure in the nip region is increased from the inlet of recording medium to the outlet of recoding medium. In this configuration, the recording medium is ejected more easily(in particular, when the recording medium is thin). The pressurization areas 22*a* and 22*b* are supported by a holder 22*c* and presses the heating roll 20 from the internal face of pressurizing belt 21 via a low-fiction layer 22*d* which is formed of a glass fiber sheet such as those containing Teflon® (manufactured by DuPont), a fluorocarbon resin sheet or the like.

The heating roll 20 has a metal hollow core 20*a* having a heater lamp 24 therein and an elastomer layer 20*b* and a releasing layer 20*c* formed on the metal hollow core 20*a* in this order. The metal core 20*a*, the elastomer layer 20*b*, and the releasing layer 20*c* may be made from any known material.

Placed surrounding the heating roll 200 are a release blade 28 for removing the paper after fixation and a temperature sensor 25 for controlling a surface temperature of the beating roll.

In the fixing device shown in FIG. 3, similarly in the fixing device shown in FIG. 2, a recording medium 26 carrying an unfixed toner image 27 on the surface is conveyed in the direction indicated by arrow A by conveying means not shown in the figure and fed into the nip region formed by the heating roll 20 rotating in the direction indicated by arrow B and the pressurizing belt 21. At the time, the recording medium 26 is fed in a manner that a surface of the recording medium 26 carrying the unfixed toner image 27 and the surface of the heating roll 20 face each other. During passage of the recording medium 26 through the nip region, the unfixed toner image 27 is fixed onto the recording medium 26 by heat and pressure applied to the recording medium 26. After fixation, the recording medium is conveyed out of the nip region, removed from the heating roll 20 by a releasing blade 29, and ejected from the fee belt-fixing device. A fixation process is attained in this way.

In the heating roll-and-belt-fixing device according to the invention, a nip time, that is a period of the recording medium carrying an unfixed toner image passing through the nip region formed by the heating roll and the pressurizing belt, is preferably approximately 0.030 second or more. When the nip time is shorter than approximately 0.030 second, it becomes difficult to obtain a preferable fixing efficiency and prevent generation of the cockle and curl of the paper at the same time, and as a result it becomes necessary to raise the fixing temperature to some extent, leading to an excessive consumption of energy, deterioration in durability of components, and heating of the device. Thus, such a short nip time is not preferable. An upper limit of the nip time is not particularly limited. It is preferably approximately 0.5 second or less, accounting for a balance of fixing efficiency and a size of the device.

Figure 4:
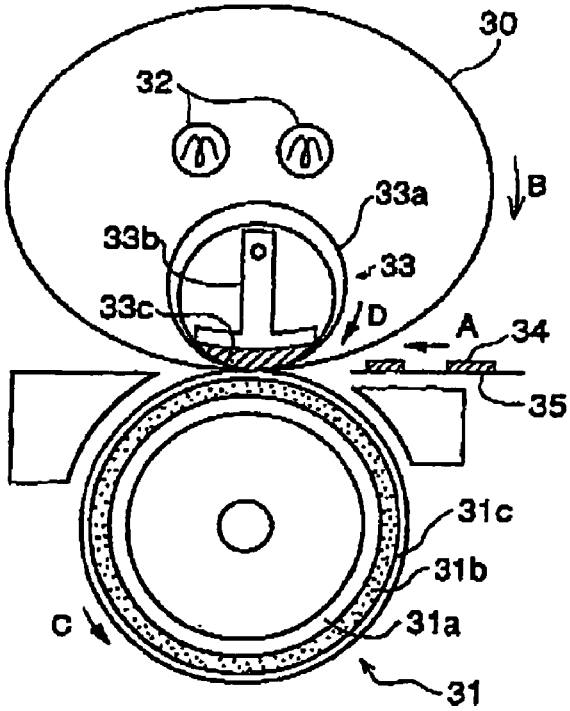
FIG. 4 is a schematic view showing a configuration of a heat belt-and-roll-fixing device relating to a third embodiment of the fixing device of the present invention.

FIG. 4 is a schematic view illustrating the configuration of a heat belt-and-roll-fixing device according to the third embodiment of the fixing device of the invention. The heat belt-and-roll-fixing device of the third embodiment is a device having a pair of fixing units, namely a heating belt and a pressuring roll in contact with the heating belt. A recording medium carrying an unfixed toner image passes through the nip region formed by the heating roll and the pressurizing belt so that the image is fixed by heat and pressure. Both the heating belt and the pressurizing roll are the fluorocarbon resin coated members according to the invention.

In the heat belt-and-roll-fixing device shown in FIG. 4, a belt 30 is a heating belt of a base heat-resistant base film (for example, polyimide firm, etc.) carrying a releasing layer formed thereon, which is a fluorocarbon resin-coated member according to the invention. A pressurizing roll 31 is placed in contact with the heating belt 30 so as to form a nip region between the heating belt 30 and the pressurizing roll 31. The pressing roll 31 is also a fluorocarbon resin-coated member according to the invention having an elastomer layer 31*b*, which is made from elastomer such as silicone rubber and formed on a base material 31*a*, and a releasing layer 31*c* formed on the elastomer layer 31*b*.

Placed inside the heating belt 30 at a position facing the pressurizing roll 31 is a pressurizing unit 33 including of a pressurizing roll 33*a*, which is made from iron or the like, a reverse T-shaped pressurization member 33*b*, and a lubricant-impregnated metal pad 33*c*, The pressurization member 33*b* presses the heating belt 30 via a pressurizing roll 33*a* to the pressurizing roll 31 so as to apply a nip pressure to the nip region. At the time, the pressurization member 33*b* is applying the nip pressure while the metal pad 33*c* is sliding along an internal surface of the pressurizing roll 33*a*. A lubricious heat-resistant oil is preferably coated on the internal surface of the pressurizing roll 33*a*. Heater lamps 32 for heating the nip area of heating belt 30 are also placed inside the heating belt 30.

The heating belt 30 rotates in the direction indicated by arrow B along the rotation of the pressurizing roll 33*a* in the direction indicated by arrow D, and the pressurizing roll 31 also rotates in the direction indicated by arrow C. A recording medium 35 carrying an unfixed toner image 34 is fed into the nip region of the fixing device in the direction indicated by arrow A, and heat-fused and pressed to provide a fixed toner image.

In this embodiment, both the heating belt 30 and the pressurizing roll 31 are the fluorocarbon resin-coated members according to the invention. Alternatively, it is possible to obtain the advantageous effects of the invention even when only one of the heating belt 30 and the pressurizing roll 31 is the fluorocarbon resin-coated member according to the invention. Of course, both of them are preferably the fluorocarbon resin-coated members according to the invention.

Figure 5:
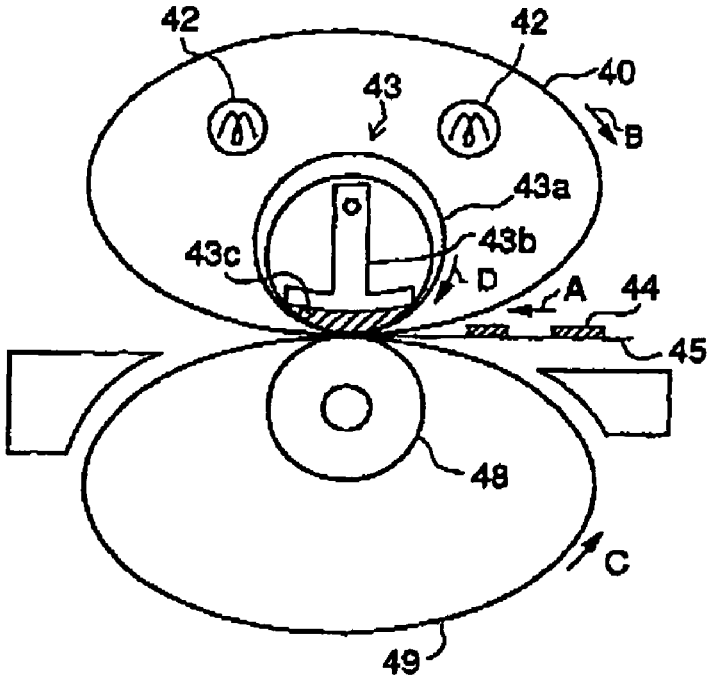
FIG. 5 is a schematic view showing a configuration of a heat belt-fixing device relating to a fourth embodiment of the fixing device of the present invention.

FIG. 5 is a schematic view illustrating the configuration of a heating belt-fixing device according to the fourth embodiment of the fixing device of the invention. The heating belt-fixing device according to the fourth embodiment is a device having a pair of fixing units, namely a beating belt and a pressing belt in contact with the heating belt. A recording medium carrying an unfixed toner image passes through the nip region formed by the heating roll and the pressurizing belt so that the image is fixed by heat and pressure. Both the heating belt and the pressurizing belt are the fluorocarbon resin-coated members according to the invention.

The configuration of the heating belt-fixing device shown in FIG. 5 including a heating belt 40, a heater lamp 42 and a pressurizing member 43 (including a pressurizing roll 43*a*, a pressurization unit 43*b* and a metal pad 43*c*) is the same as the configuration of the fixing device shown in FIG. 4 including the heating belt 30, the heater lamps 32 and the pressurizing member 33 (including the pressurizing roll 33*a*, the pressurization member 33*b* and the metal pad 33*c*). Thus, the heating belt 40 is a fluorocarbon resin-coated member according to the invention.

A pressurizing belt 49 is placed in contact with the beating belt 40 on a surface thereof, and the heating belt 40 and the pressurizing belt 49 form a nip region therebetween. The pressurizing belt 49 is a fluorocarbon resin-coated member according to the invention having the configuration identical with that of heating belt 40. Placed inside the pressurizing belt 49 are a pressurizing roll 48, which is made from a silicone rubber or the like and is positioned facing the pressurizing member 43, and a nip pressure is applied to the nip region.

The heating belt 40 rotates in the direction indicated by arrow B, together with the pressurizing roll 43*a* rotating in the direction indicated by arrow D, and the pressurizing belt 49 also rotates in the direction indicated by arrow C. A recording medium 45 carrying an unfixed toner image 44 formed thereon is fed in the direction indicated by arrow A into the nip region of the fixing device, whereby the unfixed toner image is heat-melted and pressurized so as to provide a fixed toner image.

So far described in this embodiment is a case where both the heating belt 40 and the pressuring belt 49 are the fluorocarbon resin-coated members according to the invention. Alternatively, it is also possible to obtain the advantageous effects of the invention when only one of the beating belt 40 and the pressurizing belt 49 is the fluorocarbon resin-coated member according to the invention. Of course, both of them we preferably the fluorocarbon resin-coated members according to the invention.

Image Forming Apparatus

The image forming apparatus of the present invention that has the fixing device of the present invention will be hereinafter explained in more detail illustrated by Figures.

The image forming apparatus has at least a toner image forming unit which provides an unfixed toner image on a recording medium and a fixing device which fixes the unfixed toner image to the recording medium.

First Embodiment of Image Forming Apparatus of the Invention

Figure 6:
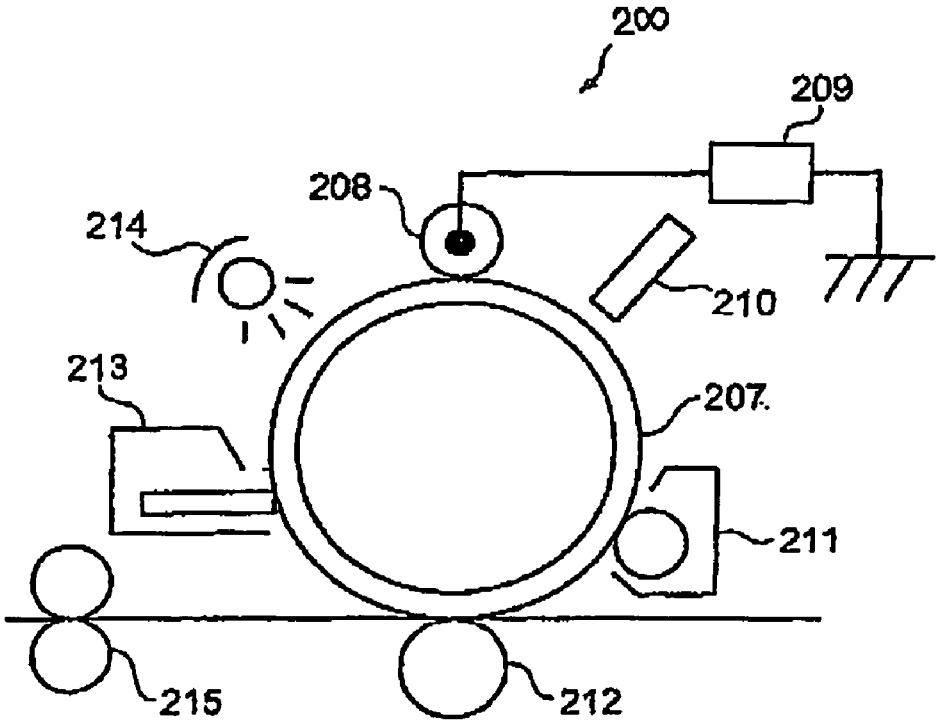
FIG. 6 is a schematic view showing a configuration of an image forming apparatus relating to a first embodiment of the image forming apparatus of the present invention.

FIG. 6 is a schematic view illustrating the configuration of the image forming apparatus of the first embodiment of the image forming apparatus of the invention. The image forming apparatus 200 shown in FIG. 6 has an electrophotographic photoreceptor 207, a charging device 208 which charges the electrophotographic photoreceptor 207 in a contact-charging process, a power source 209 connected to the charging device 208, an exposure device 210 exposing the electrophotographic photoreceptor 207 charged by the charging device 208 so as to form an electrostatic latent image, a developing device 211 forming a toner image by developing the electrostatic latent image formed by the exposure device 210 with toner, a transfer device 212 transferring the toner image formed by the developing device 211 onto an image-receiving medium, a cleaning device 213, a charge eliminator 214, and a fixing device 215 which is the fixing device according to the invention. A toner-supplying device supplying the toner to the developing device 211 is also provided, although it is not shown in FIG. 6. In another embodiment of the invention, the image forming apparatus of the invention may not have the charge eliminator 214.

The electrophotographic photoreceptor 207, the charging device 208, the power source 209, the exposure device 210, the developing device 211, the transfer device 212, the cleaning device 213, and the charge eliminator 214 form a toner image-forming unit.

The charging device 208 applies a voltage uniformly to the electrophotographic photoreceptor 207 by bringing a conductive member (an charging roll) into contact with the surface of the electrophotographic photoreceptor 207 so as to charge a surface of the photoreceptor to a particular electric potential. The charging device provided to the image forming apparatus according to the invention may be that of a non-contact system by a corotron charging, a scorotron charging or the like.

During electrification of the electrophotographic photoreceptor 207 by using the conductive member, a voltage is applied to the conductive member. The applied voltage may be either a DC voltage or a DC voltage convoluted with an AC voltage. In addition to the charging roll described in this embodiment, any other member in the contact aging mode such as charging brush, charging film, or charging tube may also be used for charging. Alternatively, a non-contact mode charging by a corotron or a scorotron may also be used for charging.

Examples of the exposure devices 210 include optical devices which can irradiate light to a surface of the electrophotographic photoreceptor 207 in a desired image pattern, and specific examples thereof include a semiconductor laser, a LED (light emitting diode), and a liquid crystal shutter. Among them, use of an exposure device employing a non-coherent light is effective in preventing interference fringe caused by the conducive base material and the photosensitive layer of the electrophotographic photoreceptor 207.

Examples of the developing device 211 include a common developing device that develops images in a contact or non-contact mode with a developer containing one or two-component developer containing a magnetic or nonmagnetic component(s) or the like. Such a developing device is not particularly limited provided that it has the function described above, and may be appropriately selected in accordance its application.

Examples of the transfer devices 212 include roller-shaped contact charging members, contact transfer chargers employing a belt, a film, a rubber blade or the like, scorotron transfer chargers and corotron transfer chargers using corona discharge, and the like.

The cleaning device 213 is a device for removing the toner deposited on a surface of the electrophotographic photoreceptor after the transferring process, and the electrophotographic photoreceptor is repeatedly used in the image-forming process after the surface is cleaned thereby. Examples of the cleaning device include those having a cleaning brush, those having a cleaning roll, and the like, in addition to those having a cleaning blade as shown in the Figure. Among them, use of a device having cleaning blade is preferable. Examples of the materials for forming the cleaning blade include polyurethane rubber, neoprene rubber, silicone rubber, and the like.

The image forming apparatus in this embodiment has a charge eliminator (erase-light-irradiating device) 214 as shown in FIG. 6. The device prevents carryover of the electric potential remaining on the electrophotographic photoreceptor to the next image-forming cycle, when the electrophotographic photoreceptor is repeatedly used, and thus further improves image quality.

Second Embodiment of Image Forming Apparatus of the Invention

Figure 7:
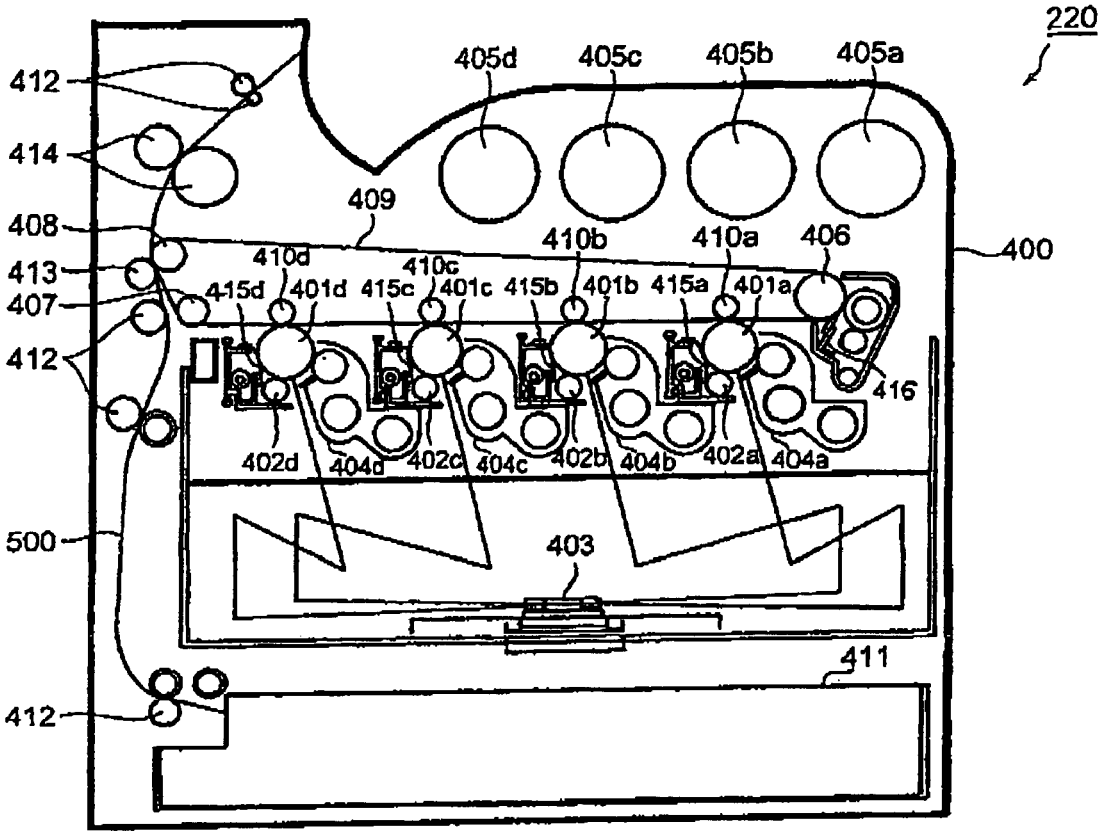
FIG. 7 is a schematic view showing a configuration of an image forming apparatus relating to a second embodiment of the image forming apparatus of the present invention.

FIG. 7 is a schematic view illustrating the configuration of the image forming apparatus according to the second embodiment of the image forming apparatus of the invention. The image forming apparatus 220 shown in FIG. 7 is an electrophotographic apparatus used for an intermediate transfer mode, and has, in its housing 400, four electrophotographic photoreceptors 401*a* to 401*d* (for example, the electrophotographic photoreceptor 401*a* can form an image in yellow, the electrophotographic photoreceptor 401*b* can form an image in magenta, the electrophotographic photoreceptor 401*c* can form an image in cyan, and the electrophotographic photoreceptor 401*d* can form an image in black) placed in parallel along an intermediate transfer belt 409.

The electrophotographic photoreceptors 401*a* to 401*d* respectively rotate in certain directions (counterclockwise in the Figure), and charging rolls 402*a* to 402*d*, developing devices 404*a* to 404*d*, primary transfer rolls 410*a* to 410*d*, and cleaning blades 415*a* to 415*d* are placed respectively along the rotation direction. Toners in four colors, black, yellow, magenta, and cyan, stored in toner cartridges 405*a* to 405*d* are supplied to the developing devices 404*a* to 404*d* respectively, and primary transfer rolls 410*a* to 410*d* are in contact with the electrophotographic photoreceptors 401*a* to 401*d* respectively via the intermediate transfer belt 409.

The electrophotographic photoreceptors 401*a* to 401*d*, the charging rolls 402*a* to 402*d*, the developing devices 404*a* to 404*d*, the primary transfer rolls 410*a* to 410*d*, and the cleaning blades 415*a* to 415*d* respectively form toner image-forming units.

In addition, a laser source (exposure device) 403 is placed at a certain position in the housing 400, and a laser beam emitted from the laser source 403 is irradiated on surfaces of the electrophotographic photoreceptors 401*a* to 401*d* after electrification.

Electrification, exposure, development, primary transfer, and cleaning are conducted while each of the electrophotographic photoreceptors 401*a* to 401*d* rotates, and each of the toner images in various colors are transferred on an intermediate transfer belt 409 in a superimposing manner.

The intermediate transfer belt 409 is supported by a drive roll 406, a backup roll 408 and a tension roll 407 at a certain tension, and driven and rotated by these rolls without deflection. In addition, a secondary transfer roll 413 is placed in contact with the backup roll 408 via the intermediate transfer belt 409. The intermediate transfer belt 409 is surface-cleaned by, for example, a cleaning blade 416 placed close to the drive roll 406, after traveling between the backup roll 408 and the secondary transfer roll 413, and then fed into the next image-forming process repeatedly.

Further, a tray 411 (recording medium tray) is placed at a certain position in the housing 400, and the recording medium 500 in the tray 411 such as paper is supplied into a region between the intermediate transfer belt 409 and the secondary transfer roll 413 and then to a fixing device 414, that is the fixing device according to the invention, by a conveying roll 412, and finally ejected out of the housing 400.

Above explanation has been given to a case in which the intermediate transfer belt 409 is used as the intermediate transfer body. The intermediate transfer body may have a belt shape such as the intermediate transfer belt 409, or alternatively, it may have a drum shape.

The recording medium is not particularly limited, as long as it can receive the transferred toner images formed on the electrophotographic photoreceptors. If the image is transferred onto an image-receiving medium such as paper directly from the electrophotographic photoreceptor, the paper corresponds to the recording medium.

EXAMPLES

The present invention will be hereinafter explained in more detail illustrated by the following examples, however the present invention is not limited to these examples. In the description below, "parts" all mean "parts by weight".

Preparation of Fluorocarbon Resin Coating Material A

About 30 parts of PFA particles (large-diameter PFA) having an average diameter of approximately 8 μm and about 70 parts of PFA particles (small-diameter PFA) having an average diameter of approximately 0.2 μm are added to about 110 parts of distilled water. Thus obtained mixture is then stirred with a revolving-blade stirrer for 30 minutes so as to provide a fluorocarbon resin coating material A.

Examples 1A and 2A and Comparative Example 1A

The fluorocarbon resin coating material A is spray-coated on a polyimide sheet sample (about 100×100 mm) to a thickness of approximately 80 μm and dried in a drying oven at approximately 80° C. for 10 minutes so as to provide a dry PFA film. In Examples 1A, the sample is treated under conditions of a pressure of approximately 120 MPa, a temperature of approximately 330° C. and a peak period of approximately 10 min, by using a hot isostatic pressing apparatus (HIP) (manufactured by Mitsubishi Heavy Industries Ltd.). In Examples 2A, the sample is treated under conditions of a pressure of approximately 320 MPa, a temperature of approximately 330° C., and a peak period of approximately 10 min by using the HIP. As a result a PFA film having a thickness of approximately 30 μm is formed on each of the polyimide sheets of the samples.

Separately, in Comparative Example 1A, a dry PFA film prepared in a similar manner to Examples 1A and 2A is treated under conditions of a temperature of approximately 330° C. and a peak period of 10 min In a hot air-circulating oven. As a result, a PFA film having a thickness of approximately 32 μm is formed on the polyimide sheet. The conditions used for manufacturing Examples 1A and 2A and Comparative Example 1A are summarized in Table 1.

Material properties including contact angle of pure water, surface roughness, surface glossiness, and film density of the obtained sheet samples are determined. Evaluation methods therefor are shown below, and evaluation results thereof are summarized in Table 2.

(1) Measurement of Contact Angle (Contact Angle of Water)

Contact angle of water: A drop of ion-change water is placed on the sample surface; and a contact angle between the drop and the sample she is determined from a side by using a contact angle analyzer manufactured by Kyowa Interface Science Co., Ltd.

(2) Measurement of Surface Roughness (Ten-Point Average Roughness RZ)

Surface roughness is measured by placing a gauge on the sample surface under a load of approximately 0.07 g and moving the gauge to a distance of approximately 2.5 mm at a traverse speed of approximately 0.03 mm/sec in a surface-roughness meter manufactured by Tokyo Seimitsu Co. Ltd. A ten-point average roughness (RZ) is determined at measurement magnifications of approximately ×50 in the horizontal direction and approximately ×5000 in the vertical direction.

(3) Measurement of Surface Glossiness

A microgrossmeter manufactured by Gardner is placed on the sample surface, and surface glossiness is determined under the condition of an incident angle/reflection angle of 75°/75°.

(4) Relative Film Density

The relative film density is determined by the method described above.

Material properties including contact angle of pure water, surface roughness, surface glossiness, and film density of the obtained sheet samples are determined. Evaluation results thereof are summarized in Table 2.

TABLE 1

| | Example 1A | Example 2A | Example 3A | Example 4A | Comparative Example 1A |
|---|---|---|---|---|---|
| Large-diameter PFA (average particle diameter/parts) | 8 μm/30 | 8 μm/30 | 8 μm/30 | 8 μm/30 | 8 μm/30 |
| Small-diameter PFA (average particle diameter/parts) | 0.2 μm/70 | 0.2 μm/70 | 0.2 μm/70 | 0.2 μm/70 | 0.2 μm/70 |
| Coating method | Spray | Spray | Spray | Spray | Spray |
| Apparatus for treatment | HIP | HIP | HIP | HIP | Hot air-circulating oven |
| Treatment conditions | 120 MPa 330° C. 10 min | 320 MPa 330° C. 10 min | 120 MPa 360° C. 10 min | 320 MPa 360° C. 10 min | 330° C. 10 min |

TABLE 2

| | Example 1A | Example 2A | Example 3A | Example 4A | Comparative Example 1A |
|---|---|---|---|---|---|
| Contact angle of water (°) | 117 | 117 | 118 | 118 | 115 |
| Surface roughness (RZ) (μm) | 2.7 | 2.5 | 2.6 | 2.5 | 2.9 |
| Surface glossiness | 45 | 46 | 47 | 48 | 42 |
| Relative film density | 99.1 | 99.4 | 99.5 | 99.8 | 97.5 |

Examples 3A and 4A

The fluorocarbon resin coating material A is spray-coated on a polyimide sheet sample (about 100×100 mm) to a thickness of approximately 80 μm and dried in a drying oven at approximately 80° C. for 10 minutes so as to provide a dry PFA film. In Example 3A, the sample is treated under conditions of a pressure of approximately 120 MPa, a temperature of approximately 360° C. and a peak period of approximately 10 min by using a hot isostatic pressing apparatus (HIP) (manufactured by Mitsubishi Heavy Industries, Ltd.). In Example 4A, the sample is treated under conditions of a pressure of approximately 320 MPa, a temperature of approximately 360° C., and a peak period of approximately 10 min by using the HP. As a result, a PFA film having a thickness of approximately 28 μm is formed on each of the polyimide sheets of the samples. The conditions used for manufacturing Examples 3A and 4A are summarized in Table 1.

Example 5A

A hollow metal core made of aluminum is prepared as a supporting body and covered with an approximately 0.8 mm thickness-elastmer layer formed of a silicone rubber composition so as to provide a roll. The fluorocarbon resin coating material A is spray-coated on a space of the roll to a thickness of approximately 80 μm so as to provide a heating-roll. The heating roll sample of Example 5A is treated under conditions of a pressure of approximately 120 MPa, a temperate of approximately 330° C. and a peak period of approximately 10 min. by using a hot isostatic pressing apparatus (HIP) (manufactured by Mitsubishi Heavy Industries, Ltd). As a result, a heating roll of Example 5A, that has a configuration of a PFA surface layer (having a releasing layer having thickness of approximately 30 μm)/silicone rubber elastmer layer/core is obtained.

Example 6A

An endless belt made of polyimide (PI) is prepared. The fluorocarbon resin coating material A is dip-coated on a surface of the belt to a thickness of approximately 80 μm. The endless belt sample of Example 6A is treated under conditions of a pressure of approximately 120 MPa, a temperature of approximately 360° C. and a peak period of approximately 10 min, by using a hot isostatic pressing apply (HIP) (manufactured by Mitsubishi Heavy Industries, Ltd.). As a result, a pressuring roll of Example 6A, that has a configuration of a PFA surface layer (having a releasing layer having thickness of approximately 30 μm)/PI endless base material is obtained.

Comparative Example 2A

A hollow metal core made of aluminum is prepared as a supporting body and covered with an approximately 0.8 mm thickness-elastmer layer formed of a silicone rubber composition so as to provide a roll. The fluorocarbon resin coating material A is spray-coated on a surface of the roll to a thickness of approximately 80 μm so as to provide a heating roll. The heating roll sample of Comparative Example 2A is tied under conditions of a temperature of approximately 330° C. and a peak period of 10 min in a hot air-circulating oven. As a result, a heating roll of Comparative Example 2A, that has a configuration of a PFA surface layer (having a releasing layer having thickness of approximately 32 μm)/silicone rubber elastmer layer/core is obtained.

Comparative Example 3A

An endless belt made of polyimide (PI) is prepared. The fluorocarbon resin coating material A is dip-coated on a surface of the belt to a thickness of approximately 80 μm. The endless belt sample of Comparative Example 3A is treated under conditions of a temperature of approximately 360° C. and E peak period of 10 min in a hot air-circulating oven. As a result, a press roll of Comparative Example 3A that has a configuration of a PFA surface layer Saving a releasing layer having thickness of approximately 32 μm)/PI endless base material is obtained.

The conditions used for manufacturing Examples 5A and 6A and Comparative Examples 2A and 3A are summarized in Table 3. Further, material properties including contact angle of pure water, surface roughness, surface glossiness, and film density of the obtained heating roll samples and p belt samples are determined in the same manner as in Example 1A. Evaluation results thereof are summarized in Table 4.

TABLE 3

| | Example 5A | Example 6A | Comparative Example 2A | Comparative Example 3A |
|---|---|---|---|---|
| Large-diameter PFA (average particle diameter/parts) | 8 μm/30 | 8 μm/30 | 8 μm/30 | 8 μm/30 |
| Small-diameter PFA (average particle diameter/parts) | 0.2 μm/70 | 0.2 μm/70 | 0.2 μm/70 | 0.2 μm/70 |
| Coating method | Spray | Dip | Spray | Dip |
| Apparatus for treatment | HIP | HIP | Hot air-circulating oven | Hot air-circulating oven |
| Treatment conditions | 120 MPa 330° C. 10 min | 120 MPa 360° C. 10 min | 330° C. 10 min | 360° C. 10 min |

TABLE 4

| | Example 5A | Example 6A | Comparative Example 2A | Comparative Example 3A |
|---|---|---|---|---|
| Contact angle of water (°) | 117 | 118 | 110 | 112 |
| Surface roughness (RZ) (μm) | 2.5 | 2.4 | 3.7 | 3.5 |
| Surface glossiness | 47 | 45 | 40 | 42 |
| Relative film density | 99.2 | 99.5 | 96.8 | 97.3 |

The heating roll and the pressurizing belt prepared in Examples 5A and 6A are placed in an electrophotographic system (trade name: DOCUCENTRECOLOR400, manufactured by Fuji Xerox Co., Ltd.) containing a fixing device having a configuration similar to that of FIG. 2, and a fixing efficiency thereof is evaluated. The electrophotographic system has a 800 W-halogen lamp heater inside the heating roll and is set to a temperature of approximately 150° C., a speed of approximately 150 m m/sec, and a nip width of approximately 8 mm. A toner used is a color toner (cyan color) for DOCUCENTRECOLOR400 (described above) (manufactured by Fuji Xerox Co., Ltd.), and a formed image is fixed on "J paper" (trade name, manufactured by Fuji Xerox Co., Ltd.). A toner density of the powder toner image formed on the recording medium paper is approximately 1mg/cm$^2$. A fixing consistency test of fixing 100,000 papers carrying an unfixed image (100 kpv(kilo print volume)) is conducted under the condition above. An abrasion wearing resistance of releasing layer is evaluated by measuring thicknesses of the releasing layers of heating roll and pressurizing belt after the test and calculating an abrasive wear amount per kpv. The fixing property, releasing property and paper-cockle resistance are evaluated according to the criteria below. The evaluation results are summarized in Table 5.

Fixing Property

A paper carrying a fixed toner image is folded inward at around the center of a solid portion of the axed toner image. A portion in which the fixed toner is broken down is wiped off with a tissue paper, and a width of a whitened line thus generated is determined. When a percentage of the area where the width of the whitened line is less than approximately 0.2 mm is approximately 80% or more, the fixing is judged as excellent Releasing Property When there is no jamming of paper (improper releasing) during continuous printing on 100 papers, the releasing property is judged as excellent.

Paper-Cockle Resistance

When there is no paper cockle during printing on 100 papers, the cockle resistance is judged as excellent.

The fixing property is evaluated by using the heating roll and the pressurizing belt prepared in Comparative Examples 2A and 3A, in a similar manner to Examples 5A and 6A. As a result, the releasing layer of the pressurizing belt is worn off at the point after approximately 55 kpv. The evaluation results are summarized in Table 5.

TABLE 5

| | Examples 5A and 6A | | Comparative Examples 2A and 3A | |
|---|---|---|---|---|
| | Beginning of fixing process | After 100 kpv | Beginning of fixing process | After 55 kpv |
| Fixing property | Excellent | Excellent | Excellent | Excellent |
| Releasing property | Excellent | Excellent | Excellent | Excellent |

TABLE 5-continued

| | Examples 5A and 6A | | Comparative Examples 2A and 3A | |
|---|---|---|---|---|
| | Beginning of fixing process | After 100 kpv | Beginning of fixing process | After 55 kpv |
| Paper-cockle resistance | Excellent | Excellent | Excellent | Excellent |
| Abrasive wear resistance of Heating roll | — | Thickness of remained releasing layer: 25 μm (= 0.05 μm/kpv) | — | Thickness of remained releasing layer After fixing 55 kpv: 25 μm (= 0.09 μm/kpv) |
| Abrasive wear resistance of Pressurizing belt | — | Thickness of remained releasing layer: 5 μm (= 0.25 μm/kpv) | — | Thickness of remained releasing layer After fixing 55 kpv: 0 μm* (= 0.58 μm/kpv) |

*32 μm-thickness of the releasing layer is worn off at the point after approximately 55 kpv.

As is apparent fore Table 5, hot isostatic pressing is effective in drastically improving the abrasion wearing resistance of releasing layer.

Preparation of Fluorocarbon Resin Coating Material B

About 30 parts of PFA particles (large-diameter. PFA) having an average diameter of approximately 8 μm, about 70 parts of PFA particles (small-diameter PFA) having an average diameter of approximately 0.2 μm, and about 10 parts of $BaSO_4$ particles (trade name: BMH-60, manufactured by Sakai Chemical Industry Co., Ltd.) having an average diameter of approximately 5 μm are added to about 110 parts of distilled water. Thus obtained mixture is then stirred with a revolving-blade stirring for 30 minutes so as to provide a fluorocarbon resin coating material B.

Preparation of Fluorocarbon Resin Coating Material C

About 30 parts of PFA particles (large-diameter PFA) having an average diameter of approximately 8 μm, about 70 parts of PFA particles (small-diameter PFA) having an average diameter of approximately 0.2 μm, and about 5 parts of zeolite particles (trade name: TOYOBUILDER, manufactured by Tosoh Corporation) having an average diameter of approximately 2 μm are added to about 110 parts of distilled water. Thus obtained mixture is then stirred with a revolving-blade stirrer for 30 minutes so as to provide a fluorocarbon resin coating material C.

Examples 1B and 2B and Comparative Example 1B

The fluorocarbon resin coating material B is spray-coated on a polyimide sheet sample (about 100×100 mm) to a thickness of approximately 80 μm and dried in a drying oven at approximately 80° C. for 10 minutes so as to provide a dry PFA film. In Examples 1B, the sample is treated under conditions of a pressure of approximately 120 MPa, a temperature of approximately 330° C. and a peak period of approximately 10 min, by using a hot isostatic pressing apparatus (HIP) (manufactured by Mitsubishi Heavy Industries, Ltd.). In Examples 2B, the sample is treated under conditions of a pressure of approximately 320 MPa, a temperature of approximately 330° C., and a peak period of approximately 10 min by using the HIP. As a result, a PEA film having a thickness of approximately 30 μm is formed on each of the polyimide sheets of the samples.

Separately, in Comparative Example 1B, a dry PFA film prepared in a similar manner to Examples 1B and 2B is treated under conditions of a temperature of approximately 330° C. and a peak period of 10 min in a hot air-circulating oven. As a result, a PFA film having a thickness of approximately 32 μm is formed on the polyimide sheet. The conditions used for manufacturing Examples 1B and 2B and Comparative Example 1B are summarized in Table 6.

Material properties including contact angle of pure water, surface roughness; surface glossiness, and film density of the obtained sheet samples are determined in the same manner as Example 1A. Evaluation results thereof are summarized in Table 7.

TABLE 6

| | Example 1B | Example 2B | Example 3B | Example 4B | Comparative Example 1B | Comparative Example 2B |
|---|---|---|---|---|---|---|
| Large-diameter PFA (average particle diameter/parts) | 8 μm/30 | 8 μm/30 | 8 μm/30 | 8 μm/30 | 8 μm/30 | 8 μm/30 |
| Small-diameter PFA (average particle diameter/parts) | 0.2 μm/70 | 0.2 μm/70 | 0.2 μm/70 | 0.2 μm/70 | 0.2 μm/70 | 0.2 μm/70 |
| Filler (average diameter/parts) | $BaSO_4$ (5 μm/10) | $BaSO_4$ (5 μm/10) | Zeolite (2 μm/5) | Zeolite (2 μm/5) | $BaSO_4$ (5 μm/10) | Zeolite (2 μm/5) |
| Coating method | Spray | Spray | Spray | Spray | Spray | Spray |
| Apparatus for treatment | HIP | HIP | HIP | HIP | Hot air-circulating oven | Hot air-circulating oven |

TABLE 6-continued

| | Example 1B | Example 2B | Example 3B | Example 4B | Comparative Example 1B | Comparative Example 2B |
|---|---|---|---|---|---|---|
| Treatment conditions | 120 MPa 330° C. 10 min | 320 MPa 330° C. 10 min | 120 MPa 360° C. 10 min | 320 MPa 360° C. 10 min | 330° C. 10 min | 360° C. 10 min |

TABLE 7

| | Example 1B | Example 2B | Example 3B | Example 4B | Comparative Example 1B | Comparative Example 2b |
|---|---|---|---|---|---|---|
| Contact angle of pure water (°) | 111 | 112 | 114 | 115 | 110 | 112 |
| Surface roughness (RZ) (μm) | 3.5 | 3.4 | 3.3 | 3.1 | 4.0 | 3.7 |
| Surface glossiness | 35 | 37 | 38 | 40 | 28 | 31 |
| Relative film density | 98.3 | 98.8 | 99.1 | 99.5 | 96.2 | 97.0 |

Examples 3B and 4B and Comparative Example 2B

The fluorocarbon resin coating material C is spray-coated on a polyimide sheet sample (about 100×100 mm) to a thickness of approximately 80 μm and dried in a drying oven at approximately 80° C. for 10 minutes so as to provide a sample. In Example 3B, the sample is treated under conditions of a pressure of approximately 120 MPa, a temperature of approximately 360° C. and a peak period of approximately 10 min, by using a hot isostatic pressing apparatus (HIP) (manufactured by Mitsubishi Heavy Industries, Ltd.). In Example 4B, the sample is treated under conditions of a pressure of approximately 320 MPa, a temperature of approximately 360° C., and a peak period of approximately 10 min by using the HIP. As a result, a PFA film having a thickness of approximately 28 μm is formed on each of the polyimide sheets of the samples.

Separately, in Comparative Example 2B, a sample prepared in a similar manner to Example 3B is treated under conditions of a temperature of approximately 360° C. and a peak period of 10 min in a hot air-circulating oven. As a result, a PFA film having a thickness of approximately 32 μm is formed on the polyimide sheet The conditions used for manufacturing Examples 3B and 4B and Comparative Example 2B are summarized in Table 6.

Material properties including contact angle of pure water, surface roughness, surface glossiness, and fair density of the obtained sheet samples are determined in the same manner as Example 1A. Evaluation results thereof are summarized in Table 7.

Example 5B

A hollow metal core made of aluminums is prepared as a supporting body and covered with an approximately 0.8 mm thickness-elastmer layer formed of a silicone rubber composition so as to provide a roll. The fluorocarbon resin coating material B is spray-coated on a surface of the roll to a thickness of approximately 80 μm so as to provide a beating roll. The heating roll sample of Example 5B is treated under conditions of a pressure of approximately 120 MPa, a temperature of approximately 330° C. and a peak period of approximately 10 min. by using a hot isostatic pressing apparatus (HIP) (manufactured by Mitsubishi Heavy industries, Ltd.). As a result, a heating roll of Example 5B, that has a configuration of a PFA surface layer (having a releasing layer having thickness of approximately 30 μm)/silicone rubber elastmer layer/core is obtained.

Example 6B

An endless belt made of polyimide (PI) is prepared. The fluorocarbon resin coating material B is dip-coated on a surface of the belt to a thickness of approximately 80 μm. The endless belt sample of Example 6A is treated under conditions of a pressure of approximately 120 MPa, a temperature of approximately 360° C. and a peak period of approximately 10 min, by using a hot isostatic pressing apparatus (HIP) (manufactured by Mitsubishi Heavy Industries, Ltd.). As a result, a pressurizing roll of Example 6B, that has a configuration of a PFA surface layer (having a releasing layer having thickness of approximately 30 μm)/PI endless base material is obtained.

Comparative Example 3B

A hollow metal core made of aluminum is prepared as a supporting body and covered with an approximately 0.8 mm thickness-elastmer layer formed of a silicone rubber composition so as to provide a roll. The fluorocarbon resin coating material B is spray-coated on a surface of the roll to a thickness of approximately 80 μm so as to provide a heating roll. The heating roll sample of Comparative Example 3B is ted under conditions of a temperature of approximately 330° C. and a peak period of 10 min in a hot air-circulating oven. As a result, a heating roll of Comparative Example 3B, that has a configuration of a PFA surface layer (having a releasing layer having thickness of approximately 32 μm)/silicone rubber elastmer layer/core is obtained.

Comparative Example 4B

An endless belt made of polyimide (PI) is prepared. The fluorocarbon resin coat material B is dip-coated on a surface of the belt to a thickness of approximately 80 μm. The endless belt sample of Comparative Example 4B is treated under conditions of a temperature of approximately 360° C. and a peak period of 10 min in a hot air-circulating oven. As a result, a pressurizing belt of Comparative Example 4B, that has a configuration of a PFA surface layer (having a releasing layer having thickness of approximately 32 μm)/PI endless base material is obtained.

The conditions used for manufacturing Examples 5B and 6B and Comparative Examples 3B and 4B are summarized in Table 8. Further, material properties including contact angle of pure water, surface roughness, surface glossiness, and film density of the obtained heating roll samples and pressurizing belt samples are determined in the same manner as in Example 1A. Evaluation results thereof are summarized in Table 9.

TABLE 8

| | Example 5B | Example 6B | Comparative Example 3B | Comparative Example 4B |
|---|---|---|---|---|
| Large-diameter PFA (average particle diameter/parts) | 8 μm/30 | 8 μm/30 | 8 μm/30 | 8 μm/30 |
| Small-diameter PFA (average particle diameter/parts) | 0.2 μm/70 | 0.2 μm/70 | 0.2 μm/70 | 0.2 μm/70 |
| Filler (average diameter/parts) | $BaSO_4$ (5 μm/10) | $BaSO_4$ (5 μm/10) | $BaSO_4$ (5 μm/10) | $BaSO_4$ (5 μm/10) |
| Coating method | Spray | Dip | Spray | Dip |
| Apparatus for treatment | HIP | HIP | Hot air-circulating oven | Hot air-circulating oven |
| Treatment conditions | 120 MPa 330° C. 10 min | 120 MPa 360° C. 10 min | 330° C. 10 min | 360° C. 10 min |

TABLE 9

| | Example 5B | Example 6B | Comparative Example 3B | Comparative Example 4B |
|---|---|---|---|---|
| Contact angle of pure water (°) | 115 | 112 | 109 | 111 |
| Surface roughness (RZ) (μm) | 3.2 | 3.4 | 4.2 | 3.8 |
| Surface glossiness | 36 | 37 | 27 | 30 |
| Relative film density | 98.5 | 98.7 | 96.1 | 96.5 |

The heating roll and the pressurizing belt prepared in Examples 5B and 6B are placed in an electrophotographic system (trade name: DOCUCENTRECOLOR400, manufactured by Fuji Xerox Co., Ltd.) containing a fixing device having a configuration similar to that of FIG. 2, and a fixing efficiency thereof is evaluated. The electrophotographic system has a 800 W-halogen lamp heater inside the heating roll and is set to a temper of approximately 150° C., a speed of approximately 150 m m/sec, and a nip width of approximately 8 mm. A toner used is a color toner (cyan color) for DOCUCENTRECOLOR400 (described above) (manufactured by Fuji Xerox Co., Ltd.), and a formed image is fixed on "J paper" (trade name, manufactured by Fuji Xerox Co., Ltd.). A toner density of the powder toner image formed on the recording medium paper is approximately 1 mg/cm$^2$. A fixing consistency test of fixing 100,000 papers carrying an unfixed image (100 kpv) is conducted under the condition above. An abrasion wearing resistance of releasing layer is evaluated by measuring thicknesses of the releasing layers of heating roll and pressurizing belt after the test and calculating an abrasive wear amount per kpv. The fixing property, releasing property and paper-cockle resistance are evaluated in the same manner as above. The evaluation results are summarized in Table 10.

The fixing property is evaluated by using the heating roll and the pressurizing belt prepared in Comparative Examples 3B and 4B, in a simile manner to Examples 5B and 6B. The evaluation results are summarized in Table 10.

TABLE 10

| | Examples 5B and 6B | | Comparative Examples 3B and 4B | |
|---|---|---|---|---|
| | Beginning of fixing process | After 100 kpv | Beginning of fixing process | After 100 kpv |
| Fixing property | Excellent | Excellent | Excellent | Excellent |
| Releasing property | Excellent | Excellent | Excellent | Excellent |
| Paper-cockle resistance | Excellent | Excellent | Excellent | Excellent |
| Abrasive wear resistance of Heating roll | — | Thickness of remained releasing layer: 28 μm (= 0.02 μm/kpv) | — | Thickness of remained releasing layer: 25 μm (= 0.05 μm/kpv) |
| Abrasive wear resistance of Pressurizing belt | — | Thickness of remained releasing layer: 22 μm (= 0.08 μm/kpv) | — | Thickness of remained releasing layer: 15 μm (= 0.15 μm/kpv) |

As is apparent from Table 10, hot isostatic pressing is effective in drastically roving the abrasion wearing resistance of releasing layer.

What is claimed is:

1. A fluorocarbon resin-coated member, comprising a base material and a releasing layer formed thereon, wherein:

the releasing layer is a film obtained by sintering fluorocarbon resin particles; and a relative film density of the releasing layer is 98% or more, wherein relative film density as a percentage is calculated according to the formula:

relative film density=film specific density/absolute specific gravity of releasing layer material, in which film specific density is calculated according to the formula:

film specific density=weight of film/volume of film.

2. The fluorocarbon resin-coated member of claim 1, wherein the releasing layer comprises a filler.

3. The fluorocarbon resin-coated member of claim 1, wherein the base material is a cylindrical metal core.

4. The fluorocarbon resin-coated member of claim 1, wherein the base material is an endless belt.

5. A method for manufacturing a fluorocarbon resin-coated member, comprising:

coating a fluorocarbon resin coating material which comprises fluorocarbon resin particles on a base material; and sintering the fluorocarbon resin particles by pressurizing the fluorocarbon resin particles at a temperature which is equal to or higher than the melting point of the fluorocarbon resin particles by using a hot isostatic pressing apparatus, wherein a releasing layer having a relative film density of 98% or more is formed thereby, and relative film density as a percentage is calculated according to the formula:

relative film density=film specific density/absolute specific gravity of releasing layer material, in which film specific density is calculated according to the formula:

film specific density=weight of film/volume of film.

6. The method for manufacturing a fluorocarbon resin-coated member of claim 5, wherein the releasing layer comprises a filler.

7. The method for manufacturing a fluorocarbon resin-coated member of claim 5, wherein the base material is a cylindrical metal core.

8. The method for manufacturing a fluorocarbon resin-coated member of claim 5, wherein the base material is an endless belt.

9. A fixing device, comprising a pair of fixing units, including of a heating member and a pressurizing member which is brought into contact with the heating member with pressure, which conveys a recording medium carrying an unfixed toner image through a nip region formed by the heating member and the pressurizing member so that the unfixed image is fixed to the recording medium by heat and pressure, wherein at least one of the heating member and the pressurizing member comprises a base material and a releasing layer formed thereon;

the releasing layer is a film obtained by sintering fluorocarbon resin particles; and a relative film density of the releasing layer is 98% or more, wherein relative film density as a percentage is calculated according to the formula:

relative film density=film specific density/absolute specific gravity of releasing layer material, in which film specific density is calculated according to the formula:

film specific density=weight of film/volume of film.

10. The fixing device of claim 9, wherein the releasing layer comprises a filler.

11. The fixing device of claim 9, wherein the base material is a cylindrical metal core.

12. The fixing device of claim 9, wherein the base material is an endless belt.

13. An image forming apparatus comprising:

a toner image forming unit which provides an unfixed toner image on a recording medium; and a fixing device which fixes the unfixed toner image to the recording medium, wherein the fixing device comprises a pair of fixing units including of a heating member and a pressurizing member which is brought into contact with the heating member with pressure, and conveys the recording medium carrying the unfixed toner image through a nip region formed by the heating member and the pressurizing member so that the unfixed image is fixed to the recording medium by heat and pressure;

at least one of the heating member and the pressurizing member comprises a base material and a releasing layer formed thereon;

the releasing layer is a film obtained by sintering fluorocarbon resin particles; and a relative film density of the releasing layer is 98% or more, wherein relative film density as a percentage is calculated according to the formula:

relative film density=film specific density/absolute specific gravity of releasing layer material, in which film specific density is calculated according to the formula:

film specific density=weight of film/volume of film.

14. The image forming apparatus of claim 13, wherein the releasing layer comprises a filler.

15. The image forming apparatus of claim 13, wherein the base material is a cylindrical metal core.

16. The image forming apparatus of claim 13, wherein the base material is an endless belt.

* * * * *